US006036291A

United States Patent [19]

Röck

[11] Patent Number: 6,036,291

[45] Date of Patent: Mar. 14, 2000

[54] DRAWER

[75] Inventor: Erich Röck, Höchst, Austria

[73] Assignee: Julius Blum Gesellschaft m.b.H., Höchst, Austria

[21] Appl. No.: 09/107,483

[22] Filed: Jun. 30, 1998

[30] Foreign Application Priority Data

Jul. 3, 1997 [AT] Austria ..... 1145/97

[51] Int. Cl.[7] ..... A47B 88/00

[52] U.S. Cl. ..... 312/333; 312/334.14

[58] Field of Search ..... 312/334.1, 334.4, 312/334.5, 334.7, 334.8, 334.14, 348.1, 348.2, 350, 333, 330.1; 384/22

[56] References Cited

U.S. PATENT DOCUMENTS

| | | | |
|---|---|---|---|
| 4,557,531 | 12/1985 | Rock et al. | 312/333 X |
| 5,015,047 | 5/1991 | Nock | 312/334.5 X |
| 5,281,021 | 1/1994 | Rock et al. | 312/330.1 X |

FOREIGN PATENT DOCUMENTS

| | | |
|---|---|---|
| 400 796 | 8/1995 | Austria . |
| 92 15 250 | 4/1993 | Germany . |

*Primary Examiner*—Janet M. Wilkens
*Attorney, Agent, or Firm*—Wenderoth, Lind & Ponack, L.L.P.

[57] ABSTRACT

A drawer includes two drawer side members into each of which a pull-out rail of a pull-out guide set is releasably hung. Each pull-out rail has at its rear end a hook which projects horizontally above the pull-out rail and by which it can be hung on the drawer side member. Each drawer side member has at its front region a rearwardly directed rigid hook which engages under a horizontal web of the pull-out rail. Each drawer side member is provided with a locking part which is movable transversely to the pull-out rail and prevents horizontal relative movement between the drawer side member and the pull-out rail. The drawer side members have near their rear ends a horizontal stop which prevents horizontal displacement of the drawer side member relative to the pull-out rail. When the drawer rests on the pull-out rails, the hooks of the drawer side members and the hooks of the pull-out rail are spaced from the pull-out rails and the drawer side members, respectively.

16 Claims, 8 Drawing Sheets

2
5
6
7
8
9
10
11
17
18

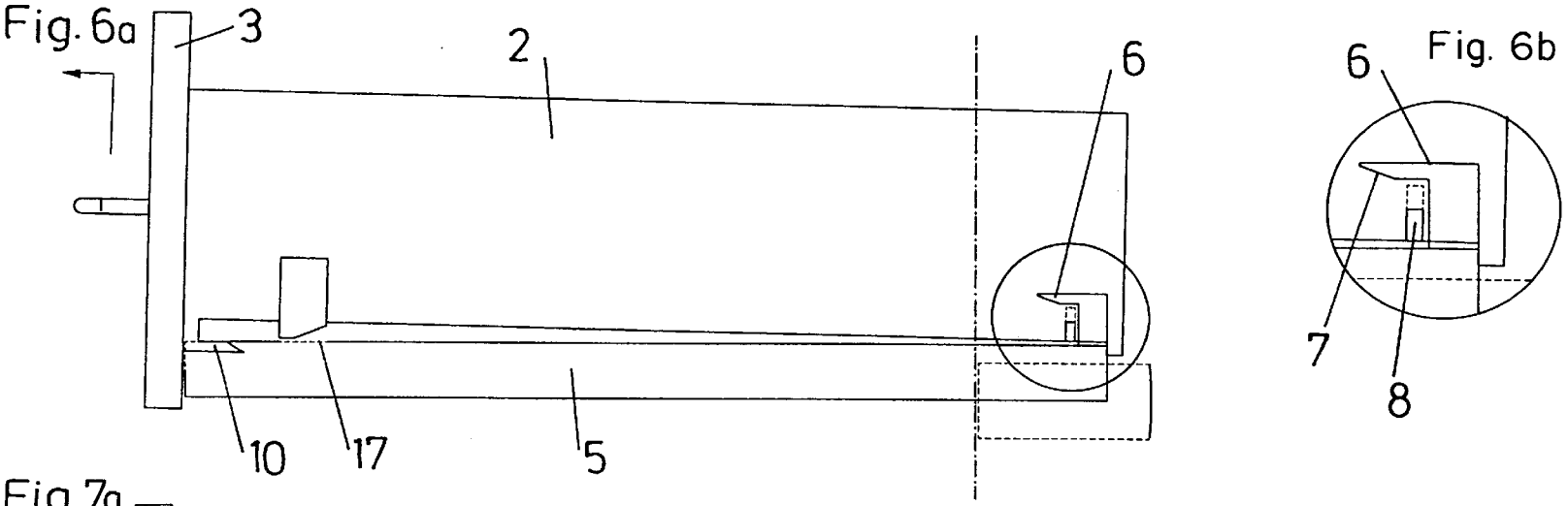
Fig. 6a
Fig. 6b
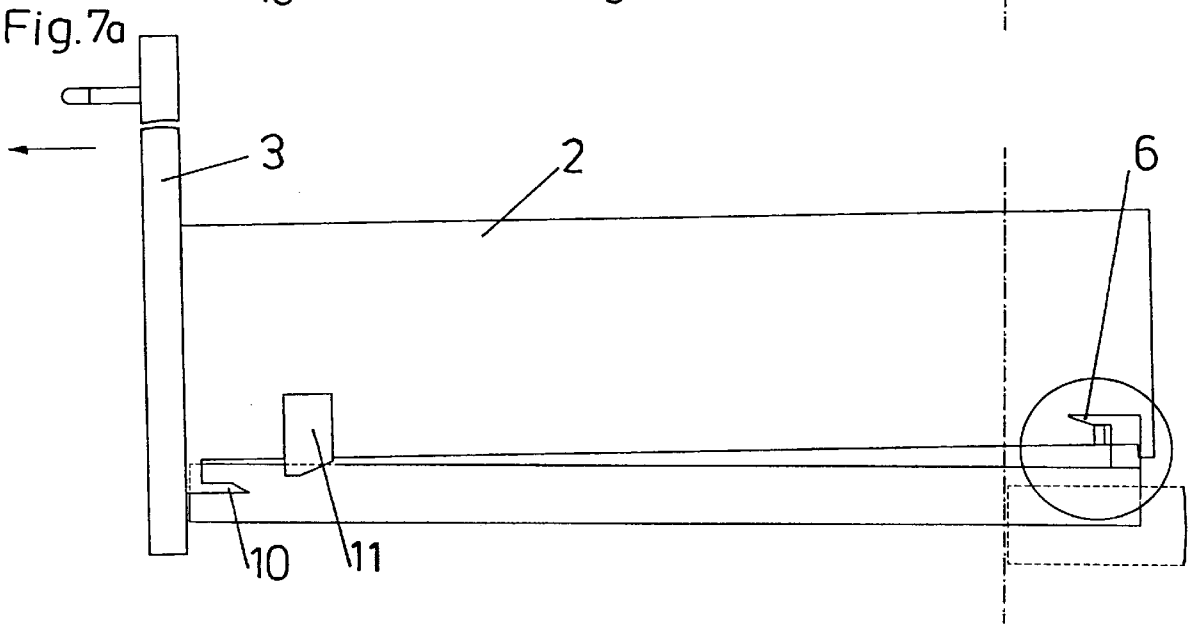
Fig. 7a
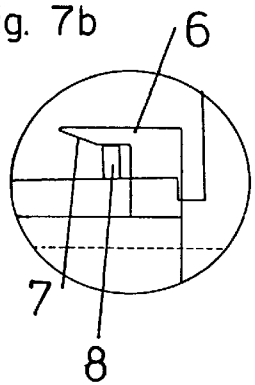
Fig. 7b

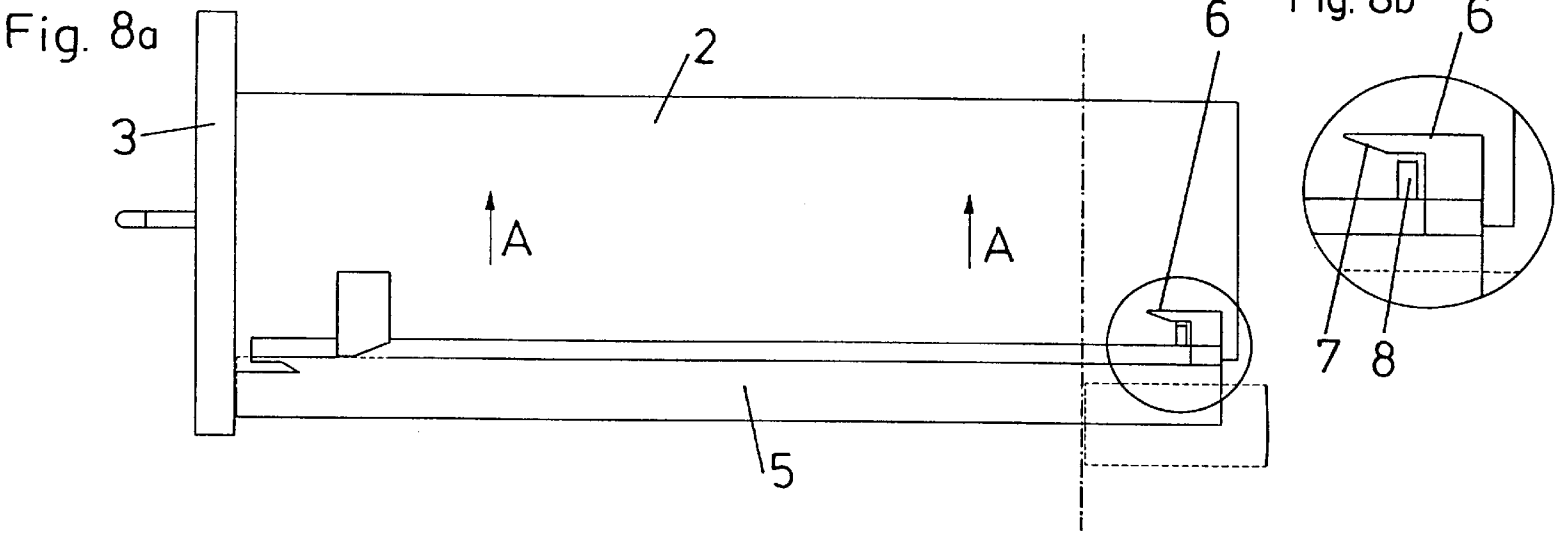
Fig. 8b
Fig. 8a
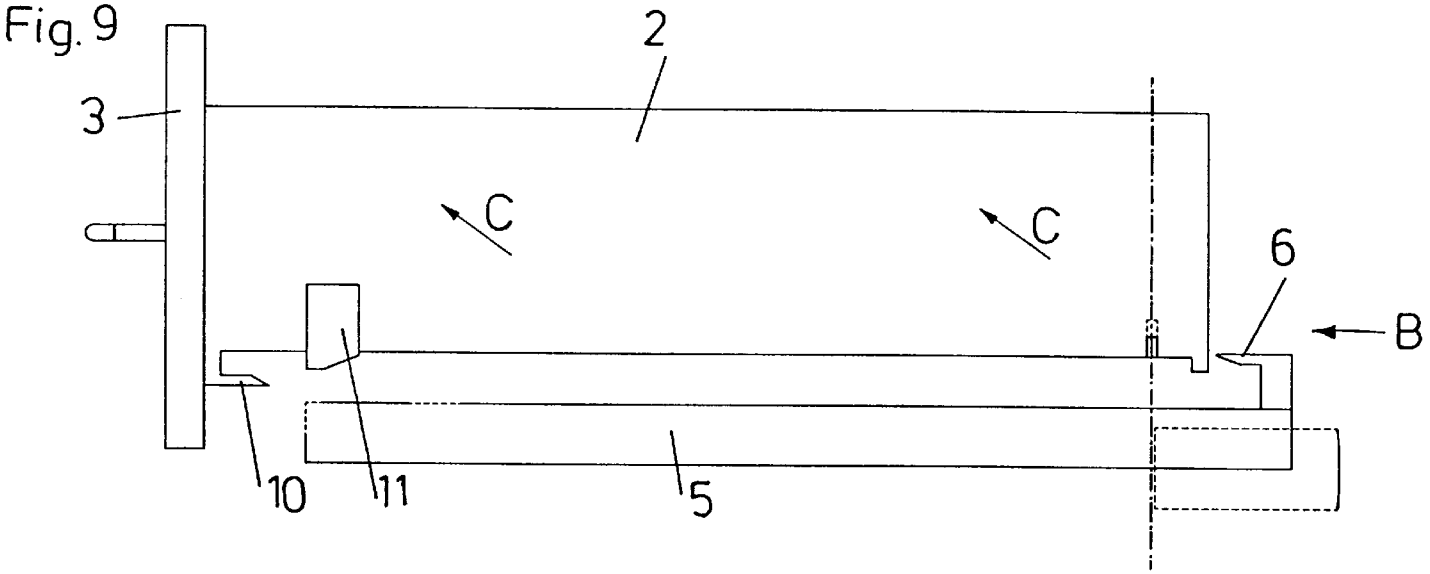
Fig. 9

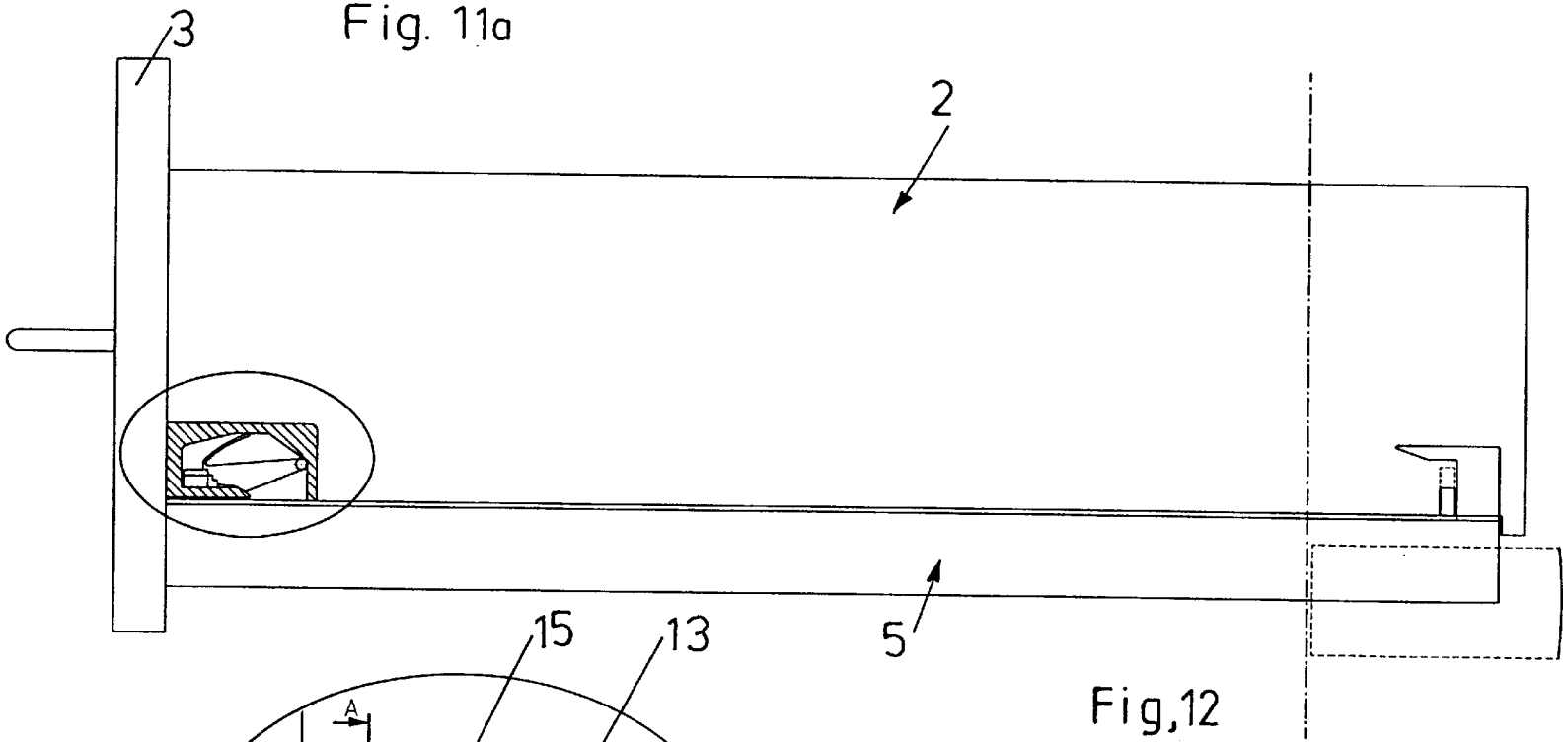
Fig. 11a
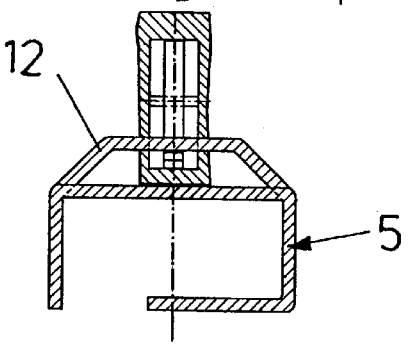
Fig,12
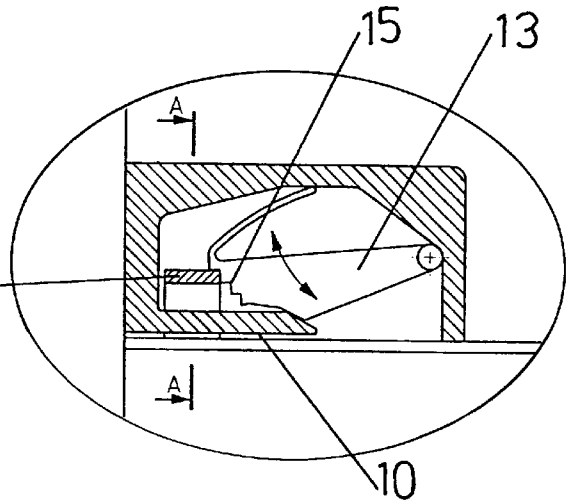
Fig. 11b

DRAWER

BACKGROUND OF THE INVENTION

1. Field of the Invention

The invention relates to the drawer with two side members into each of which a pull-out rail of a pull-out guide set is releasably hung, each pull-out rail having at its rear end a hook which projects horizontally above the pull-out rail and by which it can be hung on the respective drawer side member. Each drawer side member has at a front region thereof a rearwardly directed rigid hook which engages under a horizontal web of the respective pull-out rail. Each drawer side member is provided with a locking part which is movable transversely to the pull-out rail and prevents horizontal relative movement between the drawer member and the pull-out rail.

2. Description of the Prior Art

Drawers are known in which the pull-out rails of a pull-out guide set are fixedly mounted on drawer side member. When the drawer is completely removed from a furniture cabinet, the pull-out rails are detached from the cabinet-side member support rails together with the drawer.

On the other hand, drawers and pull-out guide sets are known in which the rails of the pull-out guide set always remain in the furniture cabinet, while the drawer upon insertion into the furniture cabinet is hung on the pull-out rails of the pull-out guide set. Upon complete removal of the furniture cabinet the drawer is detached from the pull-out rails of the pull-out guide set. Removal of the drawer is required, for example, for cleaning purposes. In such case, it does not matter whether the pull-out guide set is designed as a single-extension mechanism or as a so-called full-extension mechanism with, on each side of the drawer, a cabinet-side support rail, a drawer-side pull-out rail and a central rail running between these two rails.

SUMMARY OF THE INVENTION

The object of the invention is to provide a drawer which can be locked quickly and simply on the pull-out rails of a pull-out guide set and which can be released from such locking, without the need for actuating special locking parts, such as slides, tilting levers or the like. Furthermore, the object is to ensure that the drawer cannot be lifted off or torn off from the pullout rails unintentionally.

Such object according to the invention is achieved in that the drawer side members have near their rear ends respective horizontal stops which prevent horizontal displacement of the drawer side members relative to the pull-out rails, and in that, when the drawer rests on the pull-out rails, hooks of the drawer side members and hooks of the pull-out rails are spaced from the pull-out rails and the drawer side members, respectively, so that the drawer hung on the pull-out rails can be lifted from the pull-out rails by such a distance that the hooks and the horizontal stop become inoperative.

Provision is advantageously made for the horizontal stops at the rear ends of the drawer side members to be formed by downwardly directed projections which abut against the rear ends of the pull-out rails in the event of the horizontal movement between the drawer side members an the pull out rails.

In a further exemplary embodiment of the invention, provision is made for each of the drawer side members to have near its rear end an upwardly projecting and upwardly resilient web which, with the drawer mounted on the pull-out rails, presses from below on the hook arranged at the rear end of the pull-out rail, the hooks advantageously being provided with sloping or included run-on surfaces.

In order to achieve optimal positioning of the drawer on the pull-out rails, provision is made, in a further exemplary embodiment of the invention, for the pull-out rails to have near their front ends upwardly protruding bows or the like, under which rearwardly directed hooks of the drawer side members project and against which, in the arrested position, locking parts, movable in a vertical plane, of the drawer side members bear from the rear. In such case, the locking parts are advantageously formed by tilting levers rotatably mounted in the drawer side members and provided with step-like stop surfaces.

Provision is further made, according to the invention, for the drawer side members and the pull-out rails to have stops which form guides for the drawer, such that in order to separate the drawer from the pull-out rails the drawers must firstly be lifted vertically from the pull-out rails and then moved parallel to the pull-out rails and at a spacing therefrom in the drawer pull-out direction. The drawer can then be lifted from the pull-out rails obliquely upwardly and in the pull-out direction.

DESCRIPTION OF THE DRAWINGS

Two exemplary embodiments of the invention are described in detail below with reference to the accompanying drawings.

FIGS. 2 to 4*c* are side views of the drawer as it is being hung, 4*b* and 4*c* being enlarged details of FIG. 4*a;*

FIGS. 5*a*–5*c* are side views of the drawer hung in pull-out rails, FIGS. 5*b* and 5*c* being an enlarged details of FIG. 5*a;*

FIGS. 6*a*–6*b* are side views of the hung drawer, with the drawer being shown lifted up at the front, FIG. 6*b* being enlarged detail of FIG. 6*a;*

FIGS. 7*a*–7*b* are side views of the hung drawer, with the drawer being tilted downwardly at the front, FIG. 7*b* being an enlarged detail of FIG. 7*a;*

FIGS. 8*a*–9 are side views of the drawer as it is being removed or detached, FIG. 8*b* being an enlarged detail of FIG. 8*a;*

FIGS. 11*a*–11*b* are side views of the drawer with a further exemplary embodiment of a front locking part FIG. 11*b* being an enlarged detail of FIG. 11*a;*

FIG. 12 is a crossection of the locking part and of the pull-out rail; and

DESCRIPTION OF THE PREFERRED EMBODIMENTS

Figure 1:
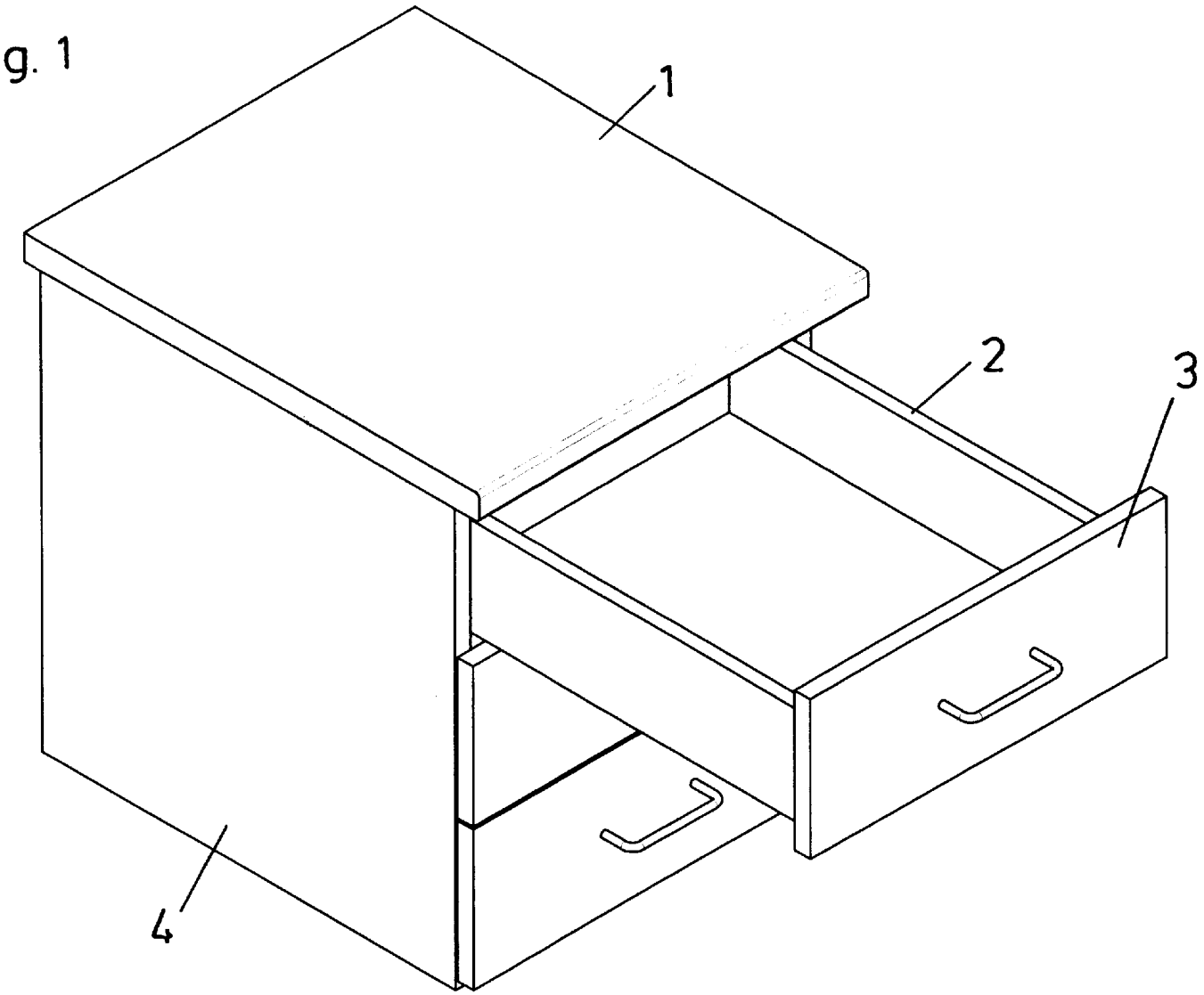
FIG. 1 is a perspective view of a furniture cabinet with a drawer according to the invention.
Figure 2:
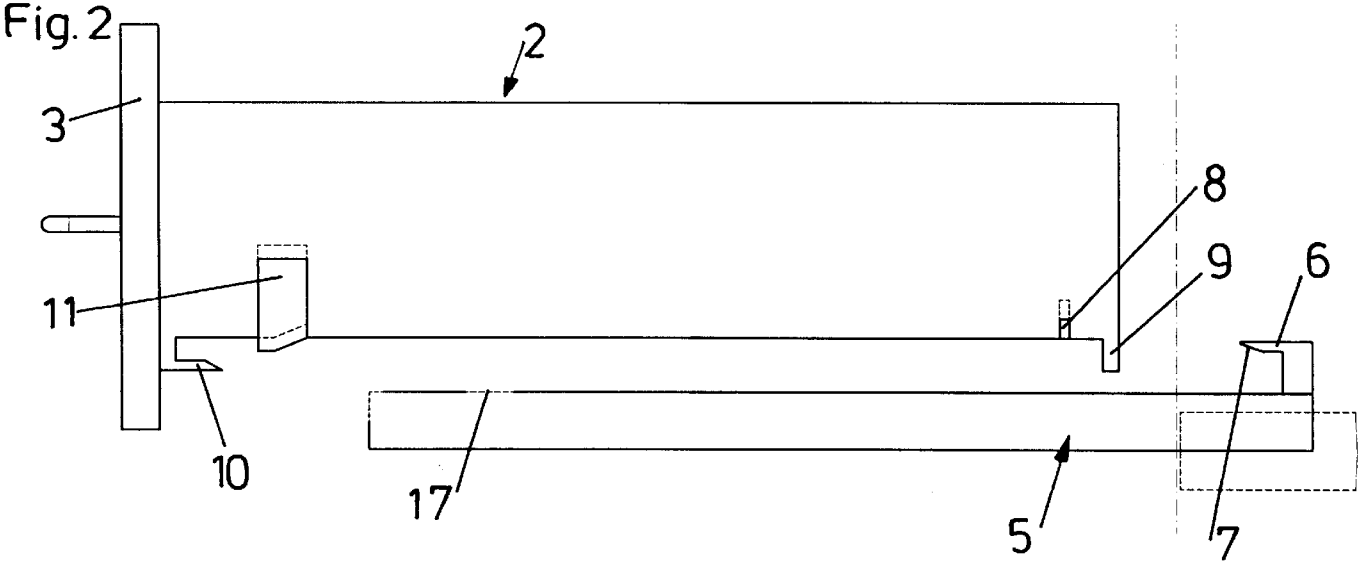
Figure 3:
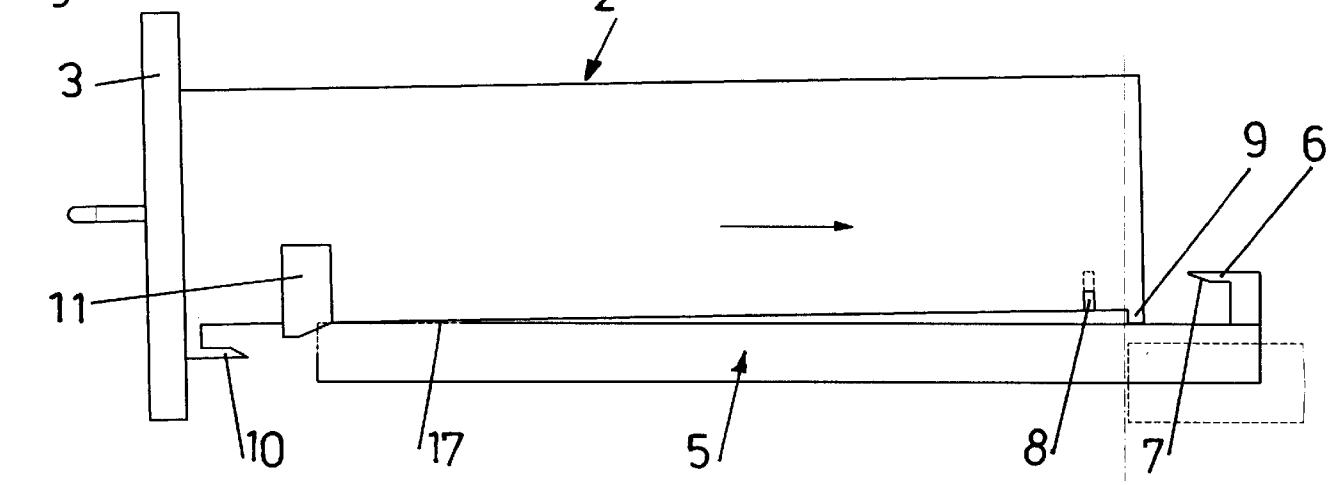
Figures 4A, 4B, 4C, 5A, 5B, 5C:
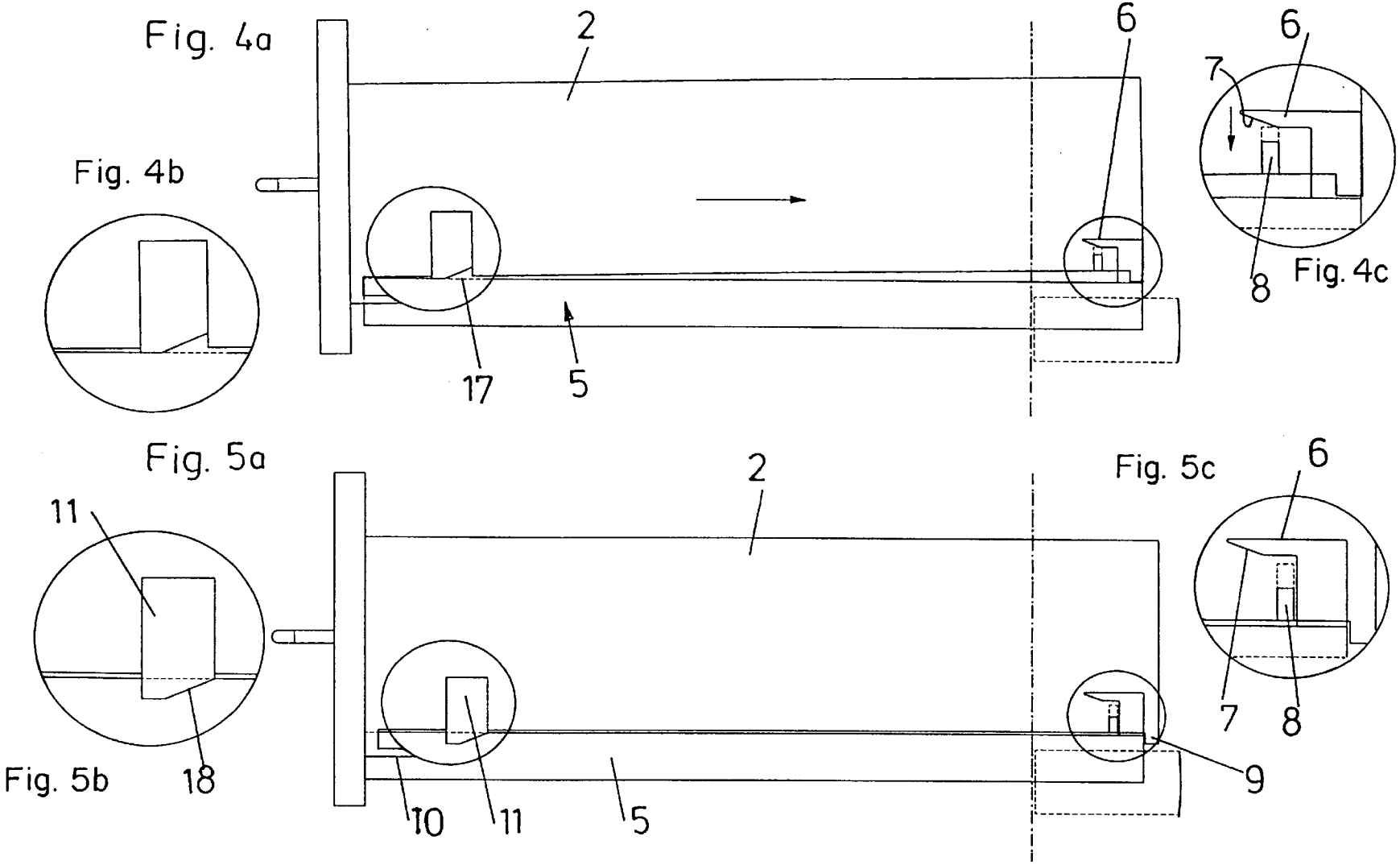

The worktop of a furniture cabinet bears the reference symbol 1 and side walls thereof the reference symbol 4. Apart from a drawer bottom and a drawer rear wall, each drawer has two drawer side members 2 and a front panel 3.

In each of the figures of the drawings, only one pull-out rail 5 of a pull-out guide set is shown. Each pull-out rail 5 has at a rear thereof a horizontally projecting hook 6 which, with the drawer mounted, is hung into the drawer side member 2 from the rear. In the front region, each drawer side member 2 is provided with a means for securing member 2 from lifting up, formed by a rearwardly directed hook 10. With the drawer anchored on the pull-out rails 5, each hook 10 projects under a horizontal web of the respective pull-out rail 5. Each drawer side member 2 further has in the front region a locking part which, in the exemplary embodiment according to FIGS. 2 to 10, is formed by a slide 11 and forms a horizontal stop for the drawer side member, such horizontal stop preventing the displacement of the drawer perpendicularly relative to the pull-out rails 5. With the drawer mounted, the slide 11 projects into a hole 17 in an upper horizontal web of the respective individual pull-out rail 5. The slide 11 is preferably acted upon by a spring which presses the slide 11 downwardly. At the rear end, each drawer side member 2 is provided with a further, but rigid horizontal stop which is formed by a downwardly extending projection 9. In the exemplary embodiments shown, with the drawer mounted the projection 9 bears again the rear end of the respective pull-out rail 5. Each drawer side member 2 is further provided, at the rear, with an upwardly protruding and upwardly resilient web 8 which, with the drawer mounted, is arranged underneath the respective hook 6. Each hook 6 has a sloping or inclined surface 7 which facilitates the sliding-in of the web 8.

The mounting or hanging of the drawer is shown in FIGS. 2 to 5*c*. In this procedure, the drawer is set onto the pull-out rails 5 from the front, so that the drawer side members 2 on the pull-out rails 5. At first, the projections 9 are supported on the horizontal webs of the pull-out rails 5. When the drawer is pushed rearwardly, the webs 8 of each individual drawer side member 2 firstly abut against the sloping surfaces 7 of the hooks 6 and are pressed downwardly, so that the drawer can be pushed rearwardly for such a distance until the projections 9 engage behind the rear ends of the pull-out rails 5 (FIG. 5*a*). Simultaneously, the slide 11 of each individual drawer side member 2 engages in the hole 17 of the corresponding pull-out rail 5 and the front rearwardly directed hooks 10 of the drawer side members 2 are situated underneath the horizontal webs of the respective pull-out rails 5. In order to facilitate such action, the slides 11 are provided with sloping or included surfaces 18. The drawer is now anchored on the pull-out rails 5 of the pull-out guide set.

If the drawer, as shown in FIG. 6*a*, is inadvertently lifted up too high at the front, which may happen particularly when a lower drawer is being pulled out, the projections 9 and the hooks 10 prevent the drawer from being lifted off the respective pull-out rails 5.

If the drawer, as shown in FIG. 7*a*, is tilted downwardly at the front, the slides 11, the hooks 6 and the resilient webs 8 prevent the drawer from being lifted off or pulled off the respective pull-out rails 5. The downwardly tilting of the drawer may occur when the latter is provided with a high front panel and the user grasps the front panel at the upper edge while pulling out the drawer.

In order to detach or remove the drawer from the cabinet, it must, as shown in FIGS. 8*a*–8*b*, firstly be lifted up straight (in the direction of the arrows A in FIG. 8*a*), so that the projections 9 and the lower ends of the slides 11 are situated just above the pull-out rails 5. Then, the drawer must be displaced horizontally, i.e., parallel to the pull-out rails 5 and spaced therefrom (arrow B in FIG. 9). In this procedure, the slides 11 (or the tilting levers 13 discussed below) and the hooks 6 and 10 are moved out of their respective holding positions. Thereafter, the drawer can, as shown in FIG. 9, be moved obliquely forwardly and upwardly (arrows C), and thus be separated or detached from the pull-out guide set.

Figure 10:
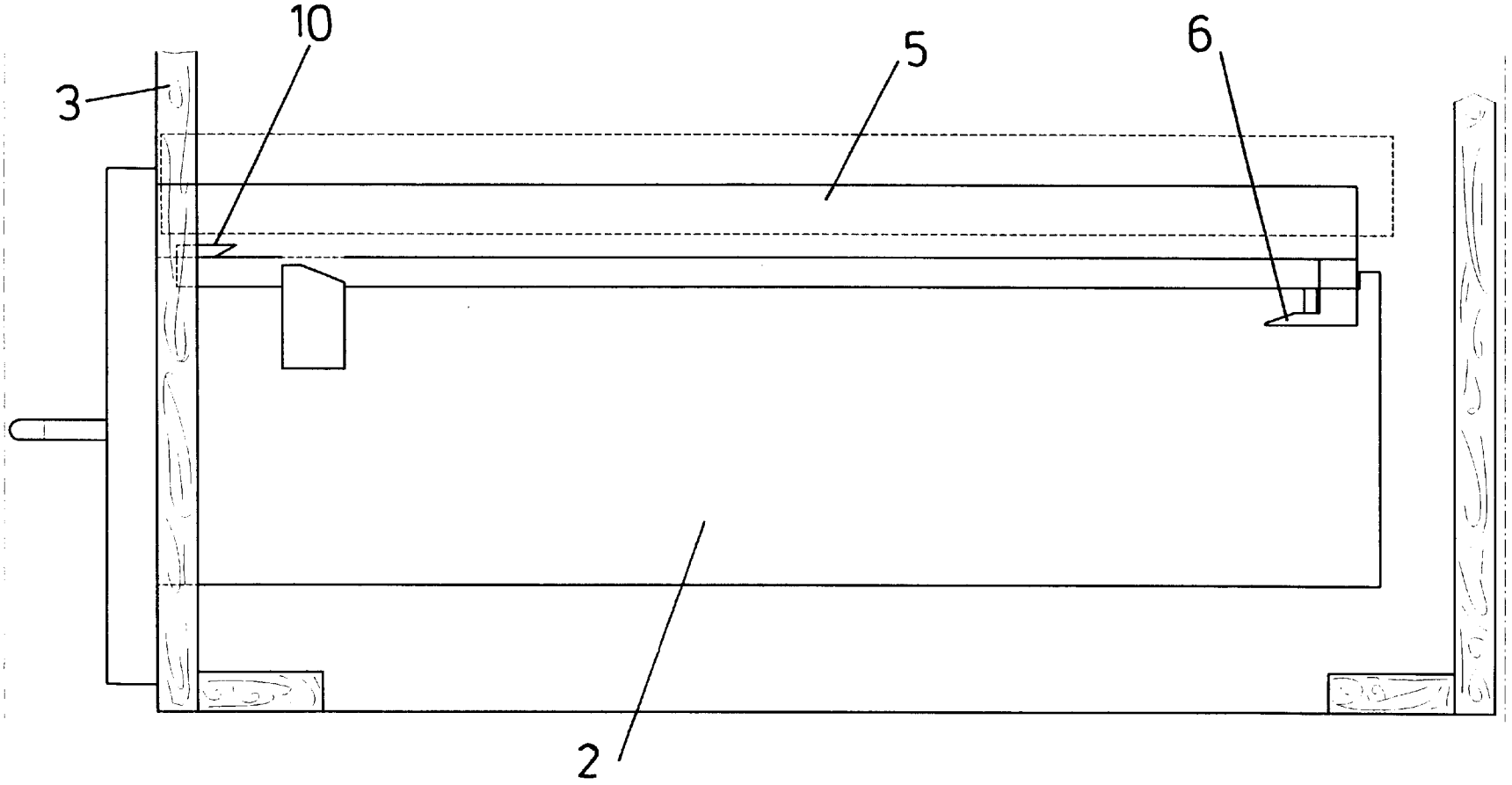
FIG. 10 is a schematic side view of the drawer in a transporting position, with the furniture cabinet upside down.
Figure 13:
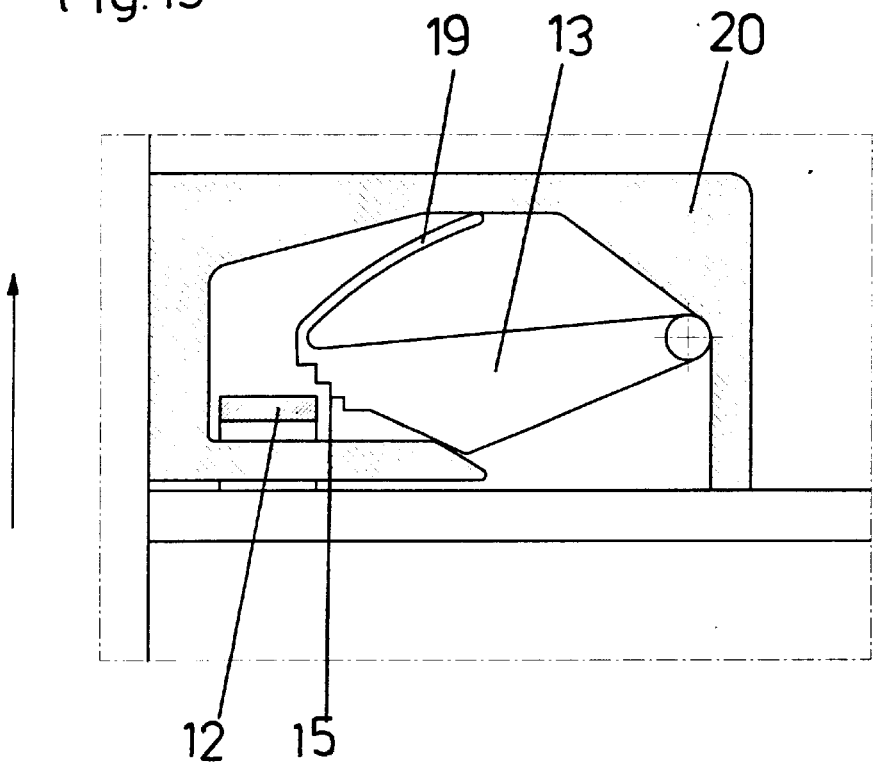
FIGS. 13 and 14 are side views of the locking part as the drawer is being detached or removed.

If the furniture cabinet is being transported with drawers hung and, as is customary in many cases, upside down, the hooks 6, 10 prevent the drawer side members 2 from being separated from the pull-out rails 5 (FIG. 10).

In the exemplary embodiment according to FIGS. 11 to 14, provision is made for a tilting lever 13 in place of the slide 11 as the front horizontal stop of the drawer side member. With the drawer set onto the pull-out rails 5, the tilting levers 13 engage, by steps 15, behind bows 12 bent upwardly from the respective pull-out rails 5. The rearwardly directed hooks 10 near the front ends of the drawer side members 2 are pushed into the bows 12 in this case. The steps 15 enable precise fixing of the drawer side members 2 in relation to the pull-out rails 5 with a relatively wide tolerance range.

The tilting levers 13 are preferably made of injection-molded plastic and have resilient lugs 19 (FIGS. 13–14) which are supported in housings 20, inserted into the drawer side members 2, and which press the respective tilting levers 13 into arrested positions.

Figure 14:
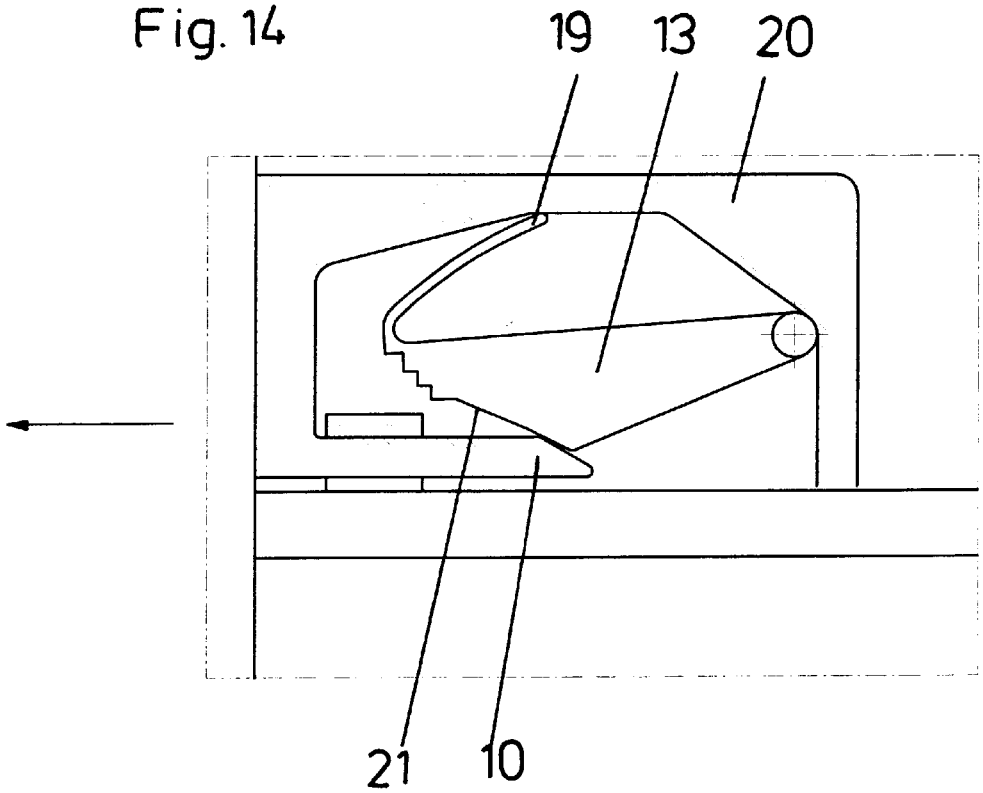

To detach or remove the drawer, the latter is lifted up vertically. In this procedure the tilting levers 13 are, as shown in FIG. 14, lifted up by the hooks 10 so that the steps 15 are situated above the bows 12. Then, the drawer can be pulled forwardly, sloping or inclined surface 21 of each individual tilting lever abutting against the respective bow 12 during this procedure, as a result of which the tilting levers 13 are turned clockwise as illustrated.

I claim the following:

1. An assembly comprising:

a drawer and a pull-out guide set for mounting said drawer for sliding movement into and out of a cabinet, said drawer including two drawer side members, and said pull-out guide set including two pull-out rails to be mounted on the cabinet and onto which are to be releasably mounted respective said drawer side members;

each said pull-out rail having at a rear end thereof a hook that projects horizontally above said each pull-out rail and by which said each pull-out rail can be mounted on said respective drawer side member;

each said drawer side member having at a front region thereof a rearwardly extending rigid hook that engages under a horizontal web of the respective said pull-out rail;

each said drawer side member having a locking part that is movable transversely of said each drawer side member to and from an operative position that prevents relative horizontal movement between said each drawer side member and said respective pull-out rail;

each said drawer side member having near a rear end thereof a stop that, in an operative position thereof, prevents horizontal displacement of said each drawer side member relative to said respective pull-out rail; and wherein, when said drawer rests on said pull-out rails, said hooks of said drawer side members and said hooks of said pull-out rails are spaced from said pull-out rails and said drawer side members, respectively, whereby said drawer can be lifted from said pull-out rails by a distance sufficient to enable each said locking part to move from said operative position thereof and to enable each said stop to be out of said operative position thereof.

2. An assembly as claimed in claim 1, wherein said stop comprises a projection extending downwardly from said rear end of the respective said drawer side member at a position to abut against said rear end of the respective said pull-out rail to prevent said horizontal displacement.

3. An assembly as claimed in claim 1, wherein each said drawer side member has near said rear end thereof an upwardly projecting and upwardly resilient web that, when said drawer is mounted on said pull-out rails, presses from below on said hook at said rear end of the respective said pull-out rail.

4. An assembly as claimed in claim 3, wherein said hook at said rear end of said respective pull-out rail has a forwardly inclined surface.

5. An assembly as claimed in claim 1, wherein said locking part comprises a slide that moves, in said operative position thereof, into a hole in the respective said pull-out rail.

6. An assembly as claimed in claim 1, wherein each said pull-out rail has protruding upwardly from a front region thereof a bow under which projects said rigid hook projecting rearwardly from said front region of the respective said drawer side member and against which said locking part abuts in said operative position thereof.

7. An assembly as claimed in claim 6, wherein said locking part is movable in a vertical plane and abuts said bow from rearwardly thereof.

8. An assembly as claimed in claim 6, wherein said locking part comprises a tilting lever rotatably mounted on said respective drawer side member and having plural stepped stop surfaces to abut said bow.

9. An assembly to be employed on each of opposite sides of a drawer to enable the drawer to be slideably movable into and out of a cabinet, said assembly comprising:

a pull-out rail to be mounted on the cabinet, and a drawer side member;

said pull-out rail having at a rear end thereof a hook that projects horizontally above said pull-out rail and by which said pull-out rail can be mounted on said drawer side member;

said drawer side member having at a front region thereof a rearwardly extending rigid hook that engages under a horizontal web of said pull-out rail;

said drawer side member having a locking part that is movable transversely of said drawer side member to and from an operative position that prevents relative horizontal movement between said drawer side member and said pull-out rail;

said drawer side member having near a rear end thereof a stop that, in an operative position thereof, prevents horizontal displacement of said drawer side member relative to said pull-out rail; and wherein, when said drawer side member is positioned on said pull-out rail, said hook of said drawer side member and said hook of said pull-out rail are spaced from said pull-out rail and said drawer side member, respectively, whereby said drawer side member can be lifted from said pull-out rail by a distance sufficient to enable said locking part to move from said operative position thereof and to enable said stop to be out of said operative position thereof.

10. An assembly as claimed in claim 9, wherein said stop comprises a projection extending downwardly from said rear end of said drawer side member at a position to abut against said rear end of said pull-out rail to prevent said horizontal displacement.

11. An assembly as claimed in claim 9, wherein said drawer side member has near said rear end thereof an upwardly projecting and upwardly resilient web that, when said drawer side member is mounted on said pull-out rail, presses from below on said hook at said rear end of said pull-out rail.

12. An assembly as claimed in claim 11, wherein said hook at said rear end of said pull-out rail has a forwardly inclined surface.

13. An assembly as claimed in claim 9, wherein said locking part comprises a slide that moves, in said operative position thereof, into a hole in said pull-out rail.

14. An assembly as claimed in claim 9, wherein said pull-out rail has protruding upwardly from a front region thereof a bow under which projects said rigid hook projecting rearwardly from said front region of said drawer side member and against which said locking part abuts in said operative position thereof.

15. An assembly as claimed in claim 14, wherein said locking part is movable in a vertical plane and abuts said bow from rearwardly thereof.

16. An assembly as claimed in claim 14, wherein said locking part comprises a tilting lever rotatably mounted on said drawer side member and having plural stepped stop surfaces to abut said bow.

* * * * *